US009358513B2

(12) United States Patent
Liu et al.

(10) Patent No.: US 9,358,513 B2
(45) **Date of Patent: *Jun. 7, 2016**

(54) METHOD AND SYSTEM FOR MAGNETIC ACTUATED MIXING

(71) Applicant: XEROX CORPORATION, Norwalk, CT (US)

(72) Inventors: Yu Liu, Mississauga (CA); Frank Ping-Hay Lee, Oakville (CA); Ke Zhou, Oakville (CA); Yulin Wang, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 535 days.

This patent is subject to a terminal disclaimer.

(21) Appl. No.: 13/860,466

(22) Filed: Apr. 10, 2013

(65) Prior Publication Data

US 2014/0307519 A1 Oct. 16, 2014

(51) Int. Cl.

*B01F 13/08* (2006.01)
*B01F 13/00* (2006.01)
*B02C 17/00* (2006.01)

(52) U.S. Cl.

CPC ..... *B01F 13/0809* (2013.01); *B01F 13/0052* (2013.01); *B01F 13/0059* (2013.01); *B01F 13/0818* (2013.01); *B02C 17/005* (2013.01)

(58) Field of Classification Search

CPC ..... B01F 13/0809
USPC ..... 366/273, 274
See application file for complete search history.

(56) References Cited

U.S. PATENT DOCUMENTS 529,766 A * 11/1894 Wheeler ..... B02C 17/161 241/105
2,175,321 A * 10/1939 Saffir ..... A61C 5/068 239/DIG. 5
2,951,689 A * 9/1960 Asp ..... B01F 13/0818 264/279.1
3,590,000 A 6/1971 Palermiti
3,644,263 A 2/1972 Burke, Jr.
3,774,885 A * 11/1973 Logvinenko ..... B01F 13/0809 204/155
3,800,588 A 4/1974 Larson
3,879,327 A 4/1975 Burke, Jr.
3,892,908 A * 7/1975 Lovness ..... C23C 24/04 118/620
3,985,649 A * 10/1976 Eddelman ..... G01N 33/54326 210/695
4,243,566 A 1/1981 Burke, Jr.
4,298,672 A 11/1981 Lu
4,310,253 A * 1/1982 Sada ..... B01F 13/0809 261/84
4,338,390 A 7/1982 Lu
5,026,427 A 6/1991 Mitchell (Continued)

OTHER PUBLICATIONS

Martin et al., "Strong intrinsic mixing in vortex magnetic fields" Physical Review E 80, 016312 (pp. 1-6) (2009).

(Continued)

*Primary Examiner* — David Sorkin

(74) *Attorney, Agent, or Firm* — Pillsbury Winthrop Shaw Pittman LLP

(57) ABSTRACT

A method and system for magnetic actuated mixing which use magnetic particles and electromagnetic field to facilitate the mixing. The method and system use magnetic particles and a generated electromagnetic field to facilitate the milling as well. The method and system can be used in any application that requires the preparation of small-sized particles at either the micro or nano scale, including for example, preparing toners, inks, wax, pigment dispersions and the like.

14 Claims, 7 Drawing Sheets

(56) References Cited

U.S. PATENT DOCUMENTS

| | | | | |
|---|---|---|---|---|
| 5,028,142 | A | 7/1991 | Ostoich | |
| 5,085,698 | A | 2/1992 | Ma | |
| 5,346,797 | A | 9/1994 | Kmiecik-Lawrynowicz | |
| 5,364,729 | A | 11/1994 | Kmiecik-Lawrynowicz | |
| 5,403,693 | A | 4/1995 | Patel | |
| 5,418,108 | A | 5/1995 | Kmiecik-Lawrynowicz | |
| 5,501,935 | A | 3/1996 | Patel | |
| 5,527,658 | A | 6/1996 | Hopper | |
| 5,585,215 | A | 12/1996 | Omg | |
| 5,650,255 | A | 7/1997 | Ng | |
| 5,650,256 | A | 7/1997 | Veregin | |
| 5,835,329 | A | 11/1998 | Sucholeiki | |
| 5,853,943 | A | 12/1998 | Cheng | |
| 5,916,725 | A | 6/1999 | Patel | |
| 6,063,827 | A | 5/2000 | Sacripante | |
| 6,120,967 | A | 9/2000 | Hopper | |
| 6,187,270 | B1 | 2/2001 | Schmitt | |
| 6,214,507 | B1 | 4/2001 | Sokol | |
| 6,593,049 | B1 | 7/2003 | Veregin | |
| 6,756,176 | B2 | 6/2004 | Stegamat | |
| 6,764,859 | B1 | 7/2004 | Kreuwel | |
| 6,830,860 | B2 | 12/2004 | Sacripante | |
| 7,517,457 | B2 | 4/2009 | Siddiqi | |
| 7,683,142 | B2 | 3/2010 | Lai | |
| 7,977,024 | B2 | 7/2011 | Zhou | |
| 8,124,309 | B2 | 2/2012 | Lai | |
| 8,163,459 | B2 | 4/2012 | Farrugia | |
| 8,168,699 | B2 | 5/2012 | Lincoln | |
| 8,871,420 | B1 * | 10/2014 | Liu | B01F 13/0809 430/137.19 |
| 2006/0063084 | A1 | 3/2006 | Sweeney | |
| 2006/0133954 | A1 * | 6/2006 | Schroeder | B01F 13/0809 422/400 |
| 2006/0222991 | A1 | 10/2006 | Sacripante | |
| 2007/0036026 | A1 * | 2/2007 | Laibinis | B01F 13/0809 366/273 |
| 2007/0207272 | A1 | 9/2007 | Puri | |
| 2014/0305340 | A1 * | 10/2014 | Liu | C08K 5/56 106/473 |

OTHER PUBLICATIONS

Wang et al., "A rapid magnetic particle driven micromixer" Microfluid Nanofluid (2008) 4:375-389.

Rida et al., "Manipulation of Self-Assembled Structures of Magnetic Beads for Microfluidic Mixing and Assaying" Anal. Chem. (2004) 76, 6239-6246.

* cited by examiner

METHOD AND SYSTEM FOR MAGNETIC ACTUATED MIXING

CROSS-REFERENCE TO RELATED APPLICATIONS

Reference is made to commonly owned and co-pending, U.S. patent application Ser. No. 13/860,474, now U.S. Pat. No. 8,871,420, entitled "METHOD AND SYSTEM FOR MAGNETIC ACTUATED MIXING TO PREPARE LATEX EMULSION" to Yu Liu et al., electronically filed on the same day herewith; and commonly owned and co-pending, U.S. patent application Ser. No. 13/860,476, now U.S. Pat. No. 9,234,090, entitled "METHOD AND SYSTEM FOR MAGNETIC ACTUATED MIXING TO PREPARE PIGMENT DISPERSIONS" to Yu Liu et al., electronically filed on the same day herewith.

BACKGROUND

The presently disclosed embodiments relate generally to a method and system for magnetic actuated mixing which use magnetic particles and electromagnetic field to facilitate the mixing. The present embodiments may be used in many different applications, including for example, preparing toners, inks, wax, pigment dispersions, paints, photoreceptor materials and the like. The present embodiments may be used for any application that requires the preparation of small-sized particles at either the micro or nano scale.

In many batch processes, the mixing step is one of most critical steps to determine the overall performance of the process. For example, in applications where small-sized particles are produced, achieving the small scale and uniform distribution of the particles is determined by the mixing step. Present mixing methods and systems do not provide uniform mixing efficiency across the entire mixing zone and are only localized at the central mixing point, for example, where the impeller tip is located. As shown in FIG. 1, a typical type of mechanical impeller mixing system 5 has conventionally been used. However, as seen, such systems suffer from non-uniform mixing efficiency across the whole mixing zone and the high mixing field 10 only localized at the impeller tip 15. The mixing strength decays as the distance increases from the impeller 15. Dead spots or shallow spots with inefficient mixing 20 are distributed along the shaft edge 25. Attempts at improvement demonstrated that global uniformity could not be easily handled by the mechanical mixing. Careful selection of a mechanical system to avoid its resonance adds further complexity.

Improvements on mixing methods and systems often generate more complex setups which have their own set of problems, such as increase mechanical maintenance of parts. Recently, acoustic mixing has been used to avoid inefficient mixing. As shown in FIG. 2, an acoustic mixing system 30 uses a non-contact mean to provide micro scale mixing 35 within a micro zone of about 50 μm in a closed vessel 40. However, generating the acoustic wave still relies on mechanical resonance as controlled by engineered plates, eccentric weights and springs. Special care and protection of the mechanism to generate mechanical resonance is typically used and any small turbulence may cause catastrophic damage on the system. Therefore, the overall service life is still limited to the effective lifetime of the mechanical components. Thus, such systems are not free of mechanical maintenance. In addition, the acoustic energy also decays at distances far away from the source.

There is thus a need for a new and improved mixing method and system that overcomes the problems encountered with the conventional systems being used as described above.

SUMMARY

In embodiments, there is provided a method for mixing one or more materials on a nano or micro scale, comprising a) adding one or more materials into a vessel, b) adding magnetic particles into the vessel, c) applying a varying magnetic field to the magnetic particles to move the magnetic particles to mix the one or more materials in the vessel, d) mixing the one or more materials in the vessel until a desired particle size is achieved, and e) collecting the magnetic particles for re-using at a later time.

Another embodiment provides a method for mixing one or more materials on a nano or micro scale, comprising a) pre-loading magnetic particles into a vessel, b) adding one or more materials into the vessel, c) applying a varying magnetic field to the magnetic particles to move the magnetic particles to mix the one or more materials in the vessel, and d) mixing the one or more materials in the vessel until a desired particle size is achieved.

In yet another embodiment, there is provided a system for mixing one or more materials on a nano or micro scale, comprising a vessel for holding one or more materials, magnetic particles for mixing the one or more materials, a source for applying a periodically varying magnetic field to the magnetic particles to move the magnetic particles to mix the one or more materials in the vessel, and a collector for collecting the magnetic particles for re-using at a later time.

BRIEF DESCRIPTION OF THE DRAWINGS

For a better understanding of the present embodiments, reference may be made to the accompanying figures.

DETAILED DESCRIPTION

Figure 1:
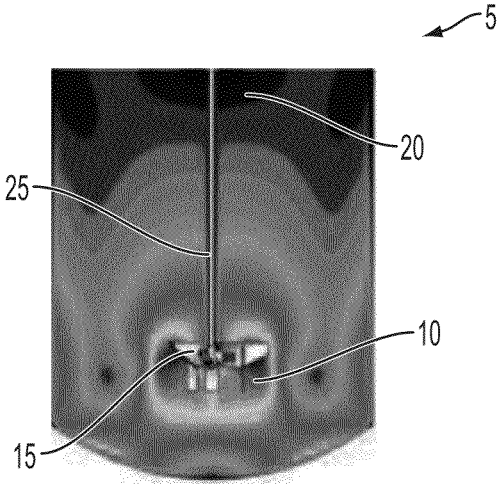
FIG. 1 PRIOR ART
FIG. 1 is a diagram of a conventional mechanical impeller mixing system.
Figure 2:
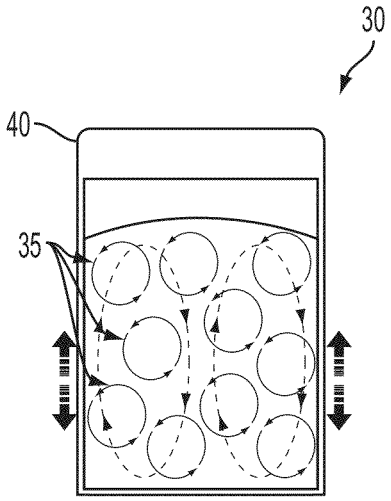
FIG. 2 PRIOR ART
FIG. 2 is a diagram of a conventional acoustic mixing system.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

Figure 3:
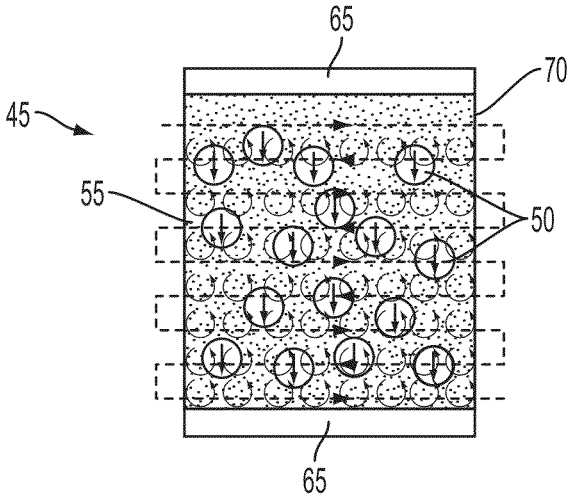
FIG. 3 is a diagram of a magnetic actuated mixing system in accordance with the present embodiments.

The present embodiments provide a method and system for magnetic actuated mixing which use magnetic particles and electromagnetic field to facilitate the mixing. In embodiments, the method and system is used for improved mixing in batch processes. As shown in FIG. 3, there is provided a mixing system 45 comprising magnetic particles 50 loaded in a solution 55 which is moved to actuate mixing by the periodic variation of a magnetic field 60 applied to the magnetic particles 50. The magnetic particles may be pre-loaded or filled into the mixing vessel 70 when mixing is needed. The magnetic field 60 is applied through electromagnets 65 on either side of the mixing vessel 70. The mixing system 45 achieves intense micro mixing zone 75 uniformly throughout the mixing vessel 70. The magnetic particles can be successfully collected and recycled by electromagnets for subsequent applications.

The magnetic particles may be comprised of diamagnetic, paramagnetic, ferrimagnetic, ferromagnetic or antiferromagnetic materials such that the overall magnetic particle is paramagnetic, ferrimagnetic, ferromagnetic or antiferromagnetic. In some exemplary embodiments, the magnetic particles may comprise Fe, $Fe_2O_3$, Ni, $CrO_2$, or Cs. In embodiments, the magnetic particles may have a non-magnetic coating. In other embodiments, the magnetic particles can also be encapsulated with a shell, for example, a polymeric shell comprising, in embodiments, polystyrene, polyvinyl chloride, TEFLON®, PMMA, and the like and mixtures thereof. The magnetic particles may have a diameter of from about 5 nm to about 50 μm, or from about 10 nm to about 10 μm, or from about 100 nm to about 5 μm. The size of magnetic particles can be chosen based on different applications or processes. In embodiments, the volume percentage of magnetic particles used for mixing may also vary depending on the different application or process for which the particles are being used. For example, from about 5% to about 80%, or from about 10% to about 50%, or from about 15% to about 25% magnetic particles may be added to the vessel. The magnetic field may have a strength of from about 500 Gauss to about 50,000 Gauss, or from about 1000 Gauss to about 20,000 Gauss, or from about 2000 Gauss to about 15,000 Gauss. In embodiments, the electromagnets are circularly patterned with a uniform angular spacing. In embodiments, the electromagnets are used to apply the varying (switchable) magnetic field in a circular motion on a micro or nano scale. The magnetic field may also be applied in an up and down, or left and right, or triangular motion. In specific embodiments, the varying magnetic field is applied by moving a permanent magnet. In embodiments, the varying magnetic field is biased by another constant magnetic field. The flexible system setup is not limited by the geometry of mixing vessel 80.

The present embodiments are able to drive chaotic or random motion of magnetic particles across the whole solution at a micro scale. This type of random motion generates turbulence and helps facilitate a high shear mixing even milling of the materials being mixed to achieve optimal particle size reduction. Every magnetic particle provides an independent mixing field or milling zone, and together generate bulk mixing which achieves an accumulative effect. The mixing is efficient and uniform across the entire mixing zone because of the uniform magnetic field distribution. If micro sized magnetic particles are used, due to the large surface contact area between micro magnetic particles and the solution, micro mixing and micro milling due to enhanced local diffusion significantly produces homogeneous and global mixing. The present embodiments thus provide small particles on the nano to micro scale and uniform distribution. The present embodiments also provide for the potential of higher viscosity (for example, a viscosity of from about 0.1 cP to about 100,000 cP at 25° C.) mixing if the exposed magnetic field is large.

Another advantage of the present method and system is the fact that it is free of mechanical components and thus maintenance, which significantly reduces the cost of the system. The present embodiments are also free of noise.

The present embodiments may be used in many different applications, including for example, preparing toners, inks, wax, pigment dispersions and the like. The present embodiments may be used for any application that requires the preparation of small-sized particles at either the micro or nano scale. In particular, the present embodiments are targeted for use in producing Emulsion Aggregation (EA) toners and pigment and latex dispersions for inks.

Latex for Emulsion Aggregation (EA) Toners

Resin latex is an important component for EA toners, which is prepared by solvent-containing batch processes such as phase inversion emulsification (PIE). In a standard batch PIE, continuous agitation is critical and is preferred to have a high mixing efficiency. At present, a mechanical mixing setup such as an impeller agitator from IKA Works, Inc. (Wilmington, N.C.) is generally used. However, as discussed above, a typical type of mechanical impeller mixing system suffers from drawback such as non-uniform mixing efficiency across the whole mixing zone, which results in dead spots or shallow spots with inefficient mixing are distributed along the shaft edge and wall. Acoustic mixing using a system from Resodyn Corp. (Butte, Mont.) has been a more widely preferred means for preparing EA toners. However, as also discussed above, such systems have their own drawbacks, such as having overall service life limited to that of the mechanical components.

The present embodiments provide a way to prepare the EA toners without the above drawbacks. In such embodiments, the cyclic magnetic field is used to actuate chaotic motion of micro or nano magnetic particles uniformly throughout whole reaction vessel to prepare resin latex with the required particle sizes. In these embodiments, magnetic particles, which are first dispersed in a solvent containing resin solution, are capable of creating micron/submicron mixing zones (depending on the magnetic particle size) with enhanced localization. Such features provide uniformity and facilitate increase in mixing speed.

Figure 4:
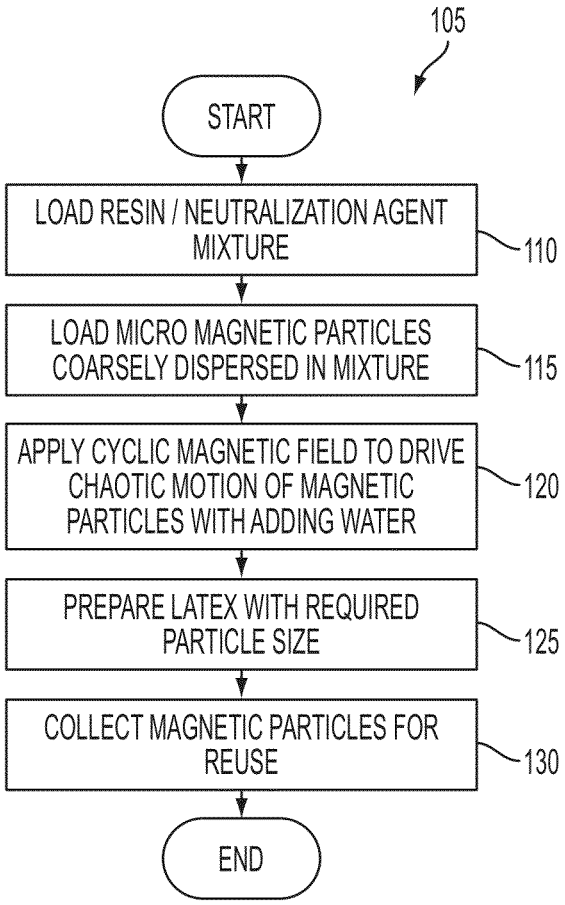
FIG. 4 is a flow chart illustrating a method for preparing a latex emulsion in accordance with the present embodiments.

In embodiments, there is provided a method for preparing EA toners using magnetic actuated mixing 105 as shown in FIG. 4. A resin (dissolved in solvent) and neutralization agent mixture is loaded into the reaction vessel 110. An optional surfactant may also be added. In embodiments, the solvent is selected from the group consisting of a ketone, an alcohol, an ester, an ether, a nitrile, a sulfone, a sulfoxide, a phosphoramide, a benzene, a benzene derivative, an amine, and mixtures thereof. In embodiments, the resin is selected from the group consisting of polyester, polyacrylate, polyolefin, polystyrene, polycarbonate, polyamide, polyimide, and mixtures thereof. In embodiments, the neutralization agent is selected from the group consisting of ammonium hydroxide, sodium carbonate, potassium hydroxide, sodium hydroxide, sodium bicarbonate, lithium hydroxide, potassium carbonate, triethyl amine, triethanolamine, pyridine, pyridine derivatives, diphenylamine, diphenylamine derivatives, poly(ethylene amine), poly(ethylene amine) derivatives, amine bases, and piepra-zine, and mixtures thereof. In embodiments, the resin/neutralization agent mixture comprises the resin and neutralization agent as a percent weight ratio of from about 25% to about 500%, or from about 50% to about 150%, or from about 70% to about 90%. In embodiments, a neutralization ratio of the neutralization agent in the latex or emulsion is from 25% to 500%. In embodiments, the surfactant is selected from ionic surfactants, nonionic surfactants, and mixtures thereof.

The reaction vessel may have the magnetic particles already pre-loaded in the vessel or the magnetic particles may be loaded into the reaction vessel after the resin/neutralization agent mixture 115. A magnetic field is applied to the resin/neutralization mixture and magnetic particles 120. Water may be added in this step. A latex with the desired particle size is then achieved by continued mixing of the magnetic particles through application of the magnetic field 125. In embodiments, the latex or emulsion has mono distribution of particle size from about 5 nm to about 1,000 nm.

Pigment Dispersions

Pigment dispersions are often used in the preparation of EA toners. For the same reasons discussed above for the preparation of the EA toners themselves, conventional milling methods used for preparing pigment dispersions suffer from many drawbacks. In addition, the use of conventional milling methods consume lengthy periods of time to prepare the pigment dispersions, often exceeding four hours.

The present embodiments provide for the use of magnetic actuating chaotic motion of magnetic particles to prepare pigment dispersions as provided by both mixing and milling capabilities at nano or micro scale. These embodiments apply cyclic magnetic field to drive the chaotic motion of the magnetic particles to provide consistent nano or micro scale shearing throughout the entire vessel, thus providing uniform dispersion of materials within a very short time frame (e.g., minutes). The magnetic particles under the varying magnetic field are also impacting on the pigment particles through enhanced head to head collision.

Figure 5:
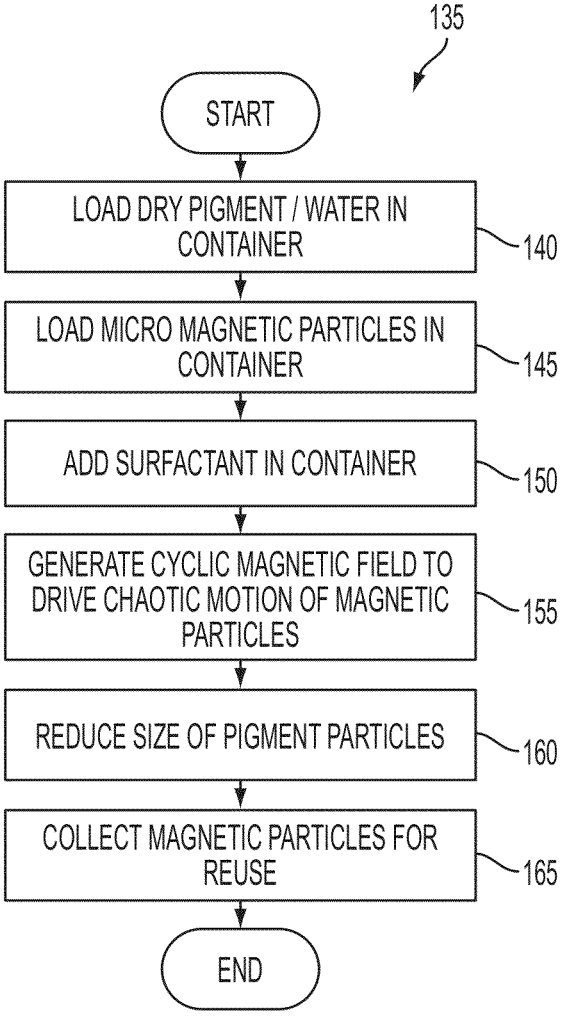
FIG. 5 is a flow chart illustrating a method for preparing a pigment dispersion in accordance with the present embodiments.

In embodiments, there is provided a method for preparing pigment dispersions using magnetic actuated mixing 135 as shown in FIG. 5. A dry pigment is loaded in a solvent, such as water, an organic solvent or mixtures thereof, into the vessel 140. In embodiments, the pigment is selected from the group consisting of a blue pigment, a black pigment, a cyan pigment, a brown pigment, a green pigment, a white pigment, a violet pigment, a magenta pigment, a red pigment, an orange pigment, a yellow pigment, and mixtures thereof. In one embodiment, the pigment is carbon black. In embodiments, the pigment/water mixture comprises the pigment and water in a weight ratio of from about 5% to about 80%, or from about 10% to about 50%, or from about 15% to about 20%.

The vessel may have the magnetic particles already pre-loaded in the vessel or the magnetic particles may be loaded into the vessel after the pigment/water mixture 145. A surfactant may then be added to the pigment/water mixture in the vessel 150. In embodiments, the surfactant can be water-soluble polymers and surfactants. In embodiments, the surfactant is added in an amount of from 1% to about 30%, or from about 3% to about 15%, or from about 5% to about 12% by weight of the total weight of the mixture in the vessel. A magnetic field is generated and applied to the mixture and magnetic particles in the vessel 155. A pigment dispersion with the desired particle size is then achieved by continued chaotic motions of the magnetic particles through application of the magnetic field. A reduction in pigment particles 160 is achieved. The duration and speed of mixing will be dependent on the pigment particle size desired. The magnetic particles can then be collected for re-use 165.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

The embodiments will be described in further detail with reference to the following examples and comparative examples. All the "parts" and "%" used herein mean parts by weight and % by weight unless otherwise specified.

Example 1

For experimental evaluation, a permanent magnet was manually moved up and down to provide a cyclic magnetic field. The cyclic frequency is about 1 Hz and total about 50 cycles were used. Optionally, an automated set up could be created. A permanent magnet was positioned at the top to provide a fixed magnetic strength. A current-driven electromagnet was positioned at the bottom to provide varying magnetic field through tuning current. Micro magnetic particles 90 (Carbonyl Iron Powder from Royalink Industries Corp., average particle size ~4 to 5 μm) were pre-loaded in a solution. When a very low current is applied from the current supply to the electromagnet, the permanent magnet plays a major role to attract all the particles to the top. When the current was increased, the overall magnetic field by both magnets will start to drive the particles to bottom.

Example 2

Pigment Dispersion Preparation

The set up described above using the permanent magnet was used to evaluate a pigment dispersion prepared by the present embodiments. Both a comparative sample (control) and inventive sample was prepared and evaluated. The switch frequency used to move the particles was about 1 Hz. After about 50 cycles (e.g., about 1 minute) mixing, the pigment sample was sent for analysis.

Comparative Example

This comparative example was done as control to show original particle size and particle size distribution of pigment particles. Into a 15 ml vial was added 0.5 g of carbon black pigment powder REGAL 330®, 5 g of deionized water (DIW), and 0.24 g (18.75 wt %) tayca power aqueous solution. The vial was then kept and shook for about 2 min (at this step a certain degree of milling/mixing has been provided). The particle size of pigment was measured with a small value peak at ~133 nm and a large value peak at ~417 nm as shown in FIG. 6.

Inventive Example

This example was prepared with the magnetic actuated milling of the present embodiments. Into a 15 ml vial was added 0.5 g of carbon black pigment powder REGAL 330®, 5 g of DIW, and 0.24 g (18.75 wt %) tayca power aqueous solution. Thereafter, 0.52 g of mcro magnetic particles (Carbonyl Iron Powder from Royalink Industries Corp., average particle size about 4 to 5 μm) was introduced. In this example, a permanent magnet was manually moved up and down to provide a cyclic magnetic field. The cyclic frequency is about 1 Hz and total about 50 cycles were used. Finally, micro magnetic particles were attracted and collected by magnet before sending the sample for analysis. The particle size of pigment was measured as shown in FIG. 7.

Figure 6:
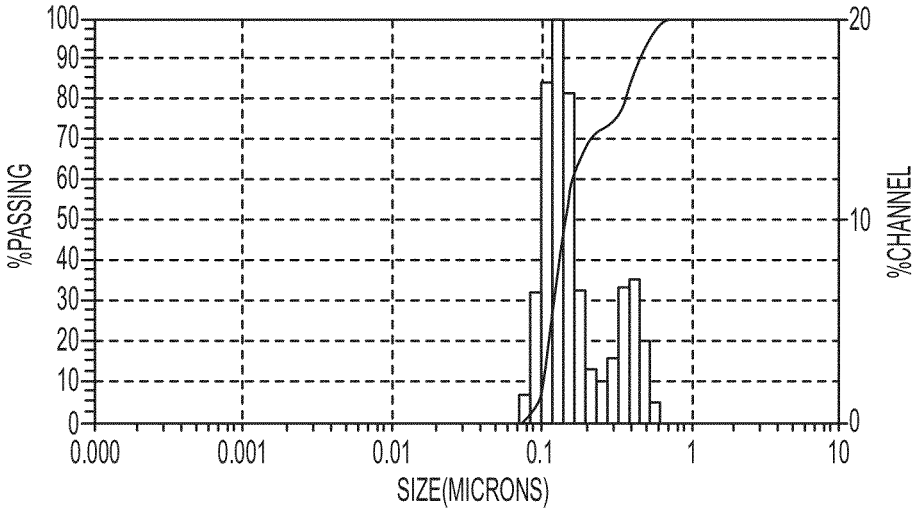
FIG. 6 is a graph illustrating particle size and particle size distribution of a pigment dispersion made in accordance with a conventional method.
Figure 7:
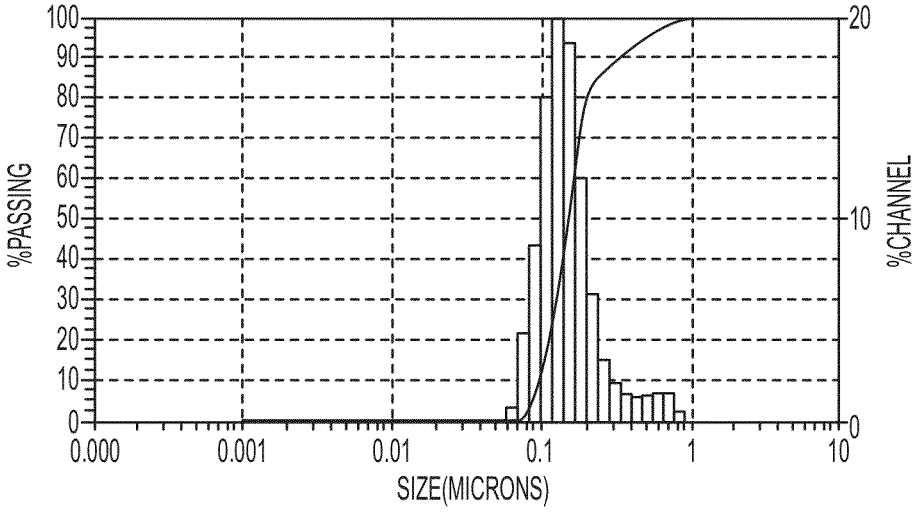
FIG. 7 is a graph illustrating particle size and particle size distribution of the pigment dispersion made in accordance with the present embodiments.

As can be seen from FIGS. 6 and 7, both size reduction and uniformity was significantly increased with the present embodiments. More specifically, the figures show that without 1 minute of the magnetic actuating process, the pigment particles show bimodal distribution with about 24% of pigment particles having average particles about 417 nm, while with magnetic mixing/milling, the pigment particles is mono distributed with average particle size of 143.7 nm<150 nm.

Example 3

Latex Emulsion Preparation

Comparative Example 1

This comparative example was done as control to show original particle size and particle size distribution of a latex emulsion as prepared with conventional phase inversion emulsification (PIE).

Figure 8:
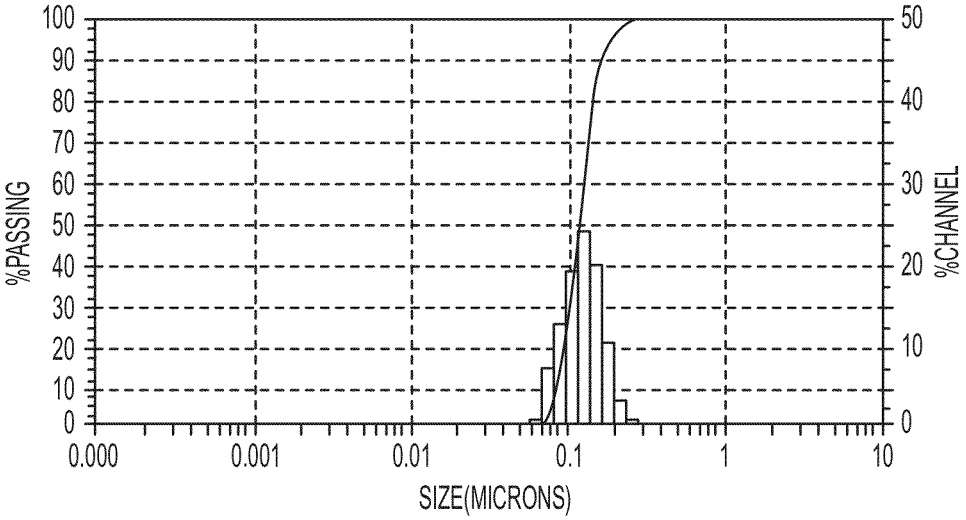
FIG. 8 is a graph illustrating particle size and particle size distribution of a first EA toner made in accordance with a conventional method.

10 g amorphous polyester resin 1 (Mw=44120, Tg onset=56.8° C.) was dissolved in 20 g methyl ethyl ketone and 2 g iso-propyl alcohol solvent mixture with stirring at room temperature. 3.24 g of the mixture was transferred to a 10 ml glass vial. 0.025 grams of 10 wt % $NH_3.H_2O$ solution was then added to neutralize the resin. Then the mixture was mixed by hand shaking. About 3.2 grams of DIW was added drop-wise to the mixture at intervals with hand shaking. The average particle size is about 129 nm as shown in FIG. 8.

Inventive Example 1

Figure 9:
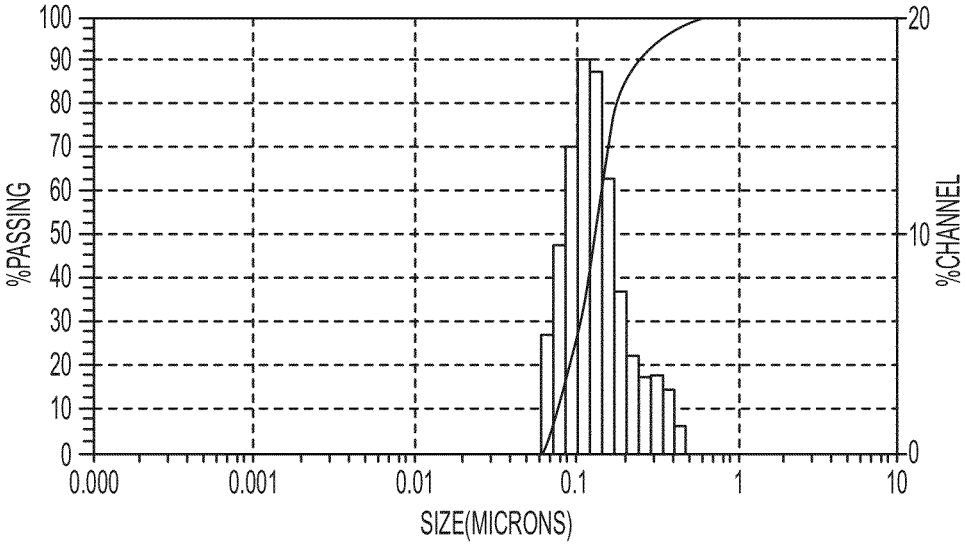
FIG. 9 is a graph illustrating particle size and particle size distribution of the first EA toner made in accordance with the present embodiments.

This example was prepared with the magnetic actuated mixing of the present embodiments. 10 g amorphous polyester resin 1 (Mw=44120, Tg onset=56.8° C.) was dissolved in 20 g methyl ethyl ketone and 2 g iso-propyl alcohol solvent mixture with stirring at room temperature. 1.62 g of the mixture was transferred to a 10 ml glass vial with 0.5 g micro magnetic particles (Carbonyl Iron Powder from Royalink Industries Corp., average particle size about 4 to 5 μm). 0.017 grams of 10 wt % $NH_3.H_2O$ solution was then added to neutralize the resin. Then the mixture was mixed by magnetic particles through turning a 15,000 Gauss permanent magnet next to the vial for about 1 min. About 1.5 grams of DIW was added drop-wise to the mixture at intervals with mixing with magnetic particles. The average particle size is about 125 nm as shown in FIG. 9.

Comparative Example 2

This comparative example was also done as control to show original particle size and particle size distribution of a latex emulsion as prepared with conventional PIE.

Figure 10:
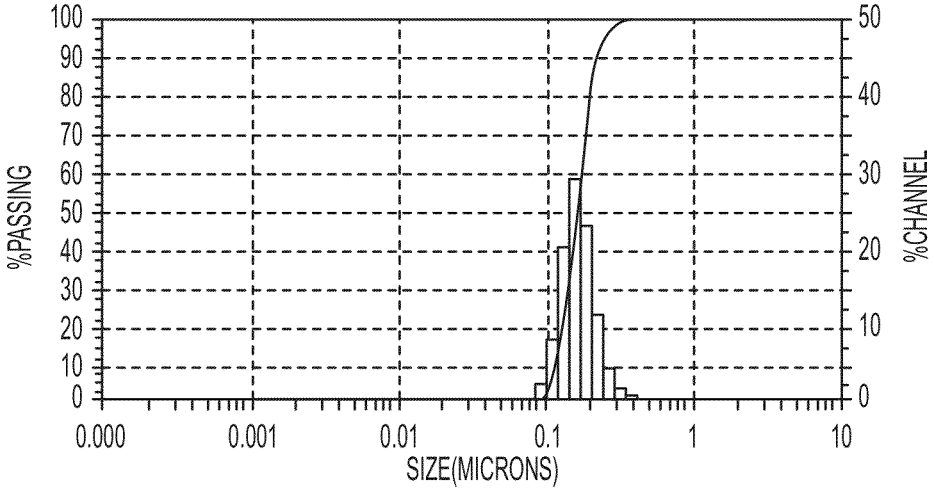
FIG. 10 is a graph illustrating particle size and particle size distribution of a second EA toner made in accordance with a conventional method.

Into a 250 ml plastic bottle was added 60 grams of bio based amorphous polyester resin 2 (Mw=83460, Tg onset=58.7 C), 60 grams of methyl ethyl ketone, 6 grams of iso-propyl alcohol. The bottle was capped and heated in stirring water bath at 60° C. overnight to dissolve the resin. After being cooled to room temperature, 5.29 grams of 10 wt % $NH_3.H_2O$ solution (calculated by the formula: Neutralization Rate×Amount of Resins in grams×Acid Number×0.303×$10^{-2}$) was then added drop-wise to the mixture to neutralize the resin. After $NH_3.H_2O$ and resin solution were shook for about 1 min, about 60 grams of DIW was added drop-wise to the mixture at intervals with shaking. The average particle size is about 163 nm as shown in FIG. 10.

Inventive Example 2

This example was also prepared with the magnetic actuated mixing of the present embodiments.

Figure 11:
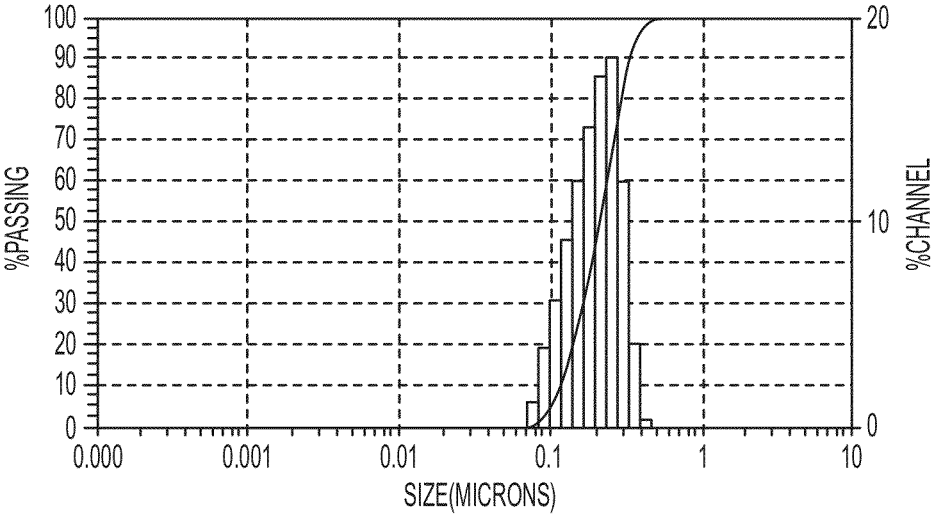
FIG. 11 is a graph illustrating particle size and particle size distribution of the second EA toner made in accordance with the present embodiments.

Into a 250 ml plastic bottle was added 60 grams of bio based amorphous polyester resin 2 (Mw=83460, Tg onset=58.7 C), 60 grams of methyl ethyl ketone, 6 grams of iso-propyl alcohol. The bottle was capped and heated in stirring water bath at 60° C. overnight to dissolve the resin. After being cooled to room temperature, 2.1 g of the mixture was transferred to a 10 mL glass vial with 0.5 g micro magnetic particles (Carbonyl Iron Powder from Royalink Industries Corp., average particle size ~4 to 5 μm). 0.09 grams of 10 wt % $NH_3.H_2O$ solution was then added drop-wise to the mixture to neutralize the resin. Then the mixture was mixed by magnetic particles through turning the vial next to the fastened permanent magnet for 1 min. About 2 grams of DIW was added drop-wise to the mixture at intervals with mixing with magnetic particles. The particle size and particle size distribution were subsequently analyzed. The average particle size is about 209 nm as shown in FIG. 11.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for mixing one or more materials on a nano or micro scale, comprising:

a) adding one or more materials into a vessel;

b) adding magnetic particles into the vessel, wherein the magnetic particles have a particle diameter size of from about 5 nm to about 50 μm and are encapsulated in a polymeric shell;

c) applying a varying magnetic field to the magnetic particles to move the magnetic particles to mix the one or more materials in the vessel on a micro or nano scale, wherein the varying magnetic field is biased by another constant magnetic field;

d) mixing the one or more materials in the vessel until a desired particle size is achieved; and e) collecting the magnetic particles for re-using at a later time.

2. The method of claim 1, wherein the one or more materials includes materials used to make a toner, ink, wax, paint or photoreceptor material.

3. The method of claim 1, wherein the magnetic particles are comprised of a, paramagnetic, ferromagnetic, ferrimagnetic or antiferromagnetic material.

4. The method of claim 1, wherein from about 5% to about 80% volume percentage of magnetic particles are added to the vessel.

5. The method of claim 1, wherein the magnetic field has a strength of from about 500 Gauss to about 50,000 Gauss.

6. The method of claim 1, wherein the magnetic field is applied through one or more electromagnets.

7. The method of claim 1, wherein the magnetic field is applied to drive magnetic particles in a circular, up and down, left and right, or triangular motion.

8. The method of claim 6, wherein the one or more electromagnets are circularly patterned with a uniform angular spacing.

9. The method of claim 1, wherein the varying magnetic field is applied by moving a permanent magnet.

10. A method for mixing one or more materials on a nano or micro scale, comprising:

a) pre-loading magnetic particles into a vessel, wherein the varying magnetic field is biased by another constant magnetic field and further wherein the magnetic particles have a particle diameter size of from about 5 nm to about 50 μm and are encapsulated in a polymeric shell;

b) adding one or more materials into the vessel;

c) applying a varying magnetic field to the magnetic particles to move the magnetic particles to mix the one or more materials in the vessel on a micro or nano scale, wherein the varying magnetic field is applied from a source external to the vessel;

d) mixing the one or more materials in the vessel until a desired particle size is achieved; and e) collecting the magnetic particles for re-using at a later time.

11. The method of claim 10, wherein the magnetic particles are comprised of a paramagnetic, ferromagnetic, ferrimagnetic or antiferromagnetic material.

12. The method of claim 10, wherein the magnetic field has a strength of from about 500 Gauss to about 50,000 Gauss.

13. The method of claim 10, wherein the magnetic field is applied to drive the magnetic particles in a circular, up and down, left and right or triangular motion.

14. The method of claim 10, wherein the varying magnetic field is applied by moving a permanent magnet.

* * * * *